US008974243B2

(12) United States Patent
Friese et al.

(10) Patent No.: US 8,974,243 B2
(45) Date of Patent: Mar. 10, 2015

(54) CABLE FOR TRANSMITTING SIGNALS

(71) Applicant: MD Elektronik GmbH, Waldkraiburg (DE)

(72) Inventors: Norbert Friese, Taufkirchen (DE); Martin Huber, Obing (DE)

(73) Assignee: MD Elektronik GmbH, Waldkraiburg (DE)

( * ) Notice: Subject to any disclaimer, the term of this patent is extended or adjusted under 35 U.S.C. 154(b) by 47 days.

(21) Appl. No.: 13/765,357

(22) Filed: Feb. 12, 2013

(65) Prior Publication Data

US 2013/0217277 A1 Aug. 22, 2013

(30) Foreign Application Priority Data

Feb. 16, 2012 (EP) ..... 12000997

(51) Int. Cl.

| | |
|---|---|
| ***H01R 13/64*** | (2006.01) |
| ***H01R 13/42*** | (2006.01) |
| ***H01R 13/436*** | (2006.01) |
| ***H01R 24/40*** | (2011.01) |
| *H01R 13/645* | (2006.01) |
| *H01R 13/646* | (2011.01) |

(52) U.S. Cl.

CPC ..... *H01R 13/42* (2013.01); *H01R 13/4367* (2013.01); *H01R 24/40* (2013.01); *H01R 13/6456* (2013.01); *H01R 13/646* (2013.01)

USPC ..... 439/374; 439/595

(58) Field of Classification Search

USPC ..... 439/595, 374

See application file for complete search history.

(56) References Cited

U.S. PATENT DOCUMENTS

| | | | | |
|---|---|---|---|---|
| 3,888,559 | A * | 6/1975 | Geib | 439/258 |
| 4,986,758 | A * | 1/1991 | Wakata | 439/595 |
| 5,044,977 | A * | 9/1991 | Vindigni | 439/374 |
| 6,416,346 | B1 * | 7/2002 | Nakamura | 439/374 |
| 6,764,350 | B2 | 7/2004 | Kosmala | |
| 6,843,677 | B2 * | 1/2005 | Fukuda | 439/374 |
| 7,056,159 | B2 * | 6/2006 | Fukatsu et al. | 439/752 |
| 7,223,131 | B2 * | 5/2007 | Moll et al. | 439/752 |
| 7,264,510 | B2 * | 9/2007 | Koenig et al. | 439/620.14 |

(Continued)

FOREIGN PATENT DOCUMENTS

| | | |
|---|---|---|
| DE | 20 2010 009 598 | 10/2010 |
| WO | 2010/115514 | 10/2010 |

OTHER PUBLICATIONS

European Search Report, dated Jul. 23, 2012, issued in corresponding European Patent Application No. 12000997.2.

*Primary Examiner* — Gary Paumen

(74) *Attorney, Agent, or Firm* — Kenyon & Kenyon LLP

(57) ABSTRACT

A cable for the transmission of signals, includes a plurality of leads, on whose inner conductors an electrically conductive end piece is affixed. At least one of the end pieces includes a first latching element. The cable includes a coupler element, and the coupler element has a body having a longitudinal axis. In addition, the body has parallel feed-throughs, electrically insulated from each other, to accommodate the end pieces. At least one of the feed-throughs includes a second latching element. The end piece is inserted into the feed-through such that the first latching element locks into place with the second latching element. The body furthermore has a first surface and a second surface to guide a mating piece of the coupler element, the first surface having a radially outwardly directed normal vector, and the second surface having a radially inwardly directed normal vector.

9 Claims, 6 Drawing Sheets

(56) References Cited

U.S. PATENT DOCUMENTS 7,591,665 B2 * 9/2009 Nakamura ..... 439/374
2003/0199205 A1 10/2003 Kosmala
2004/0072465 A1 * 4/2004 Murakami ..... 439/374
2012/0034809 A1 2/2012 Reimchen

* cited by examiner

CABLE FOR TRANSMITTING SIGNALS

CROSS-REFERENCE TO RELATED APPLICATIONS

The present application claims priority to Application No. 12 000 997.2, filed in the European Patent Office on Feb. 16, 2012, which is expressly incorporated herein in its entirety by reference thereto.

FIELD OF THE INVENTION

The present invention relates to a preassembled cable, for example, a cable including a coupler element or a plug connector, for the transmission of signals.

BACKGROUND INFORMATION

Numerous cables are used in motor vehicles or aircrafts, for example, and are often required in large numbers. A simple design and an uncomplicated preassembly are of great importance for the cost-effective provision of corresponding cables. Cables of this type must be manufactured such that they allow the transmission of signals at high data rates as required in a high-quality transmission of video signals, for example.

A multi-lead shielded cable, which includes a coupler element, is described, for example, in U.S. Patent Application Publication No. 2003/0199205. One of the disadvantages of the configuration described in U.S. Patent Application Publication No. 2003/0199205 is that the transmittable data rates are limited and that relatively many additional parts are required to produce such a cable.

SUMMARY

Example embodiments of the present invention provide a cable which allows a high-quality signal transmission at high data rates and yet is able to be manufactured at relatively low production cost.

According to example embodiments of the present invention, a cable for the transmission of signals has a plurality of (especially twisted) leads, at whose internal conductors an electrically conductive end piece is affixed. At least one of the end pieces includes a first latching element. In addition, the cable has a coupler element, the coupler element having a body that has a geometrical longitudinal axis. Furthermore, the body includes parallel feed-throughs to accommodate the end pieces. The feed-throughs may extend in parallel to the longitudinal axis as well. At least one of the feed-through has a second latching element. The at least one end piece is introduced in the at least one feed-through such that the first latching element cooperates with the second latching element, so that the at least one end piece is latched to the body, or inside the body. In addition, the body has a first surface and a second surface to guide a mating piece, e.g., a mating plug, of the coupler element, the surfaces featuring an orientation such that the first surface has a radially outwardly directed normal vector, and the second surface has a radially inwardly directed normal vector.

According to conventional nomenclature in geometry, a normal vector in this context is a vector arranged orthogonally on the particular surface. In one point, the normal vector of the curved surface therefore is the normal vector of the tangential plane in this point. In the present context, both normal vectors on the individual surfaces feature an orientation such that they have a radial directional component, but different directional signs. The radial direction is an alignment orthogonal to the longitudinal axis.

In cross-section or in a cross-sectional plane having an orthogonal orientation with respect to the longitudinal axis, the surfaces may be disposed radially opposite each other, separated by an air gap.

In the following text, signals refer to, e.g., signals that are suitable for transmitting data in an Ethernet system and, for example, have a frequency of 1 MHz to 150 MHz, e.g., 80 MHz to 150 MHz. It should be appreciated that high transmission rates of the signals at a high signal quality may be achieved by an extremely precise positioning of the individual leads in the coupler element. Because of the particular arrangement of the body, these specifications are able to be met in a multi-lead cable, even if shields are dispensed with.

The cable may include no shield. The electrically conductive internal conductors of the leads normally are surrounded by insulation material, so that the lead includes an internal conductor and insulation. In the event that the cable does not require a lead including insulation, the internal conductor may be considered a lead by itself.

In order to allow mechanical coding, the cable may be arranged such that points along a circumferential line on the first surface or on the second surface or on both surfaces are situated at different distances from the longitudinal axis. Mechanical coding, for example, may denote a constructive measure to ensure that a positionally accurate plug-in connection is produced between the coupler element and a corresponding mating piece. The surfaces may include chamfers or grooves or radially projecting fins for this purpose.

It is possible to produce the body in one piece from an insulating material, e.g., by an injection-molding method, and the second latching element may be arranged as an integral component of the body.

In addition, the first surface may be axially set back with respect to the longitudinal axis, in comparison with the second surface (i.e., along the longitudinal axis).

The feed-throughs may be configured to surround the end pieces completely, at least along a circumferential line on the individual end piece, such an enclosure being provided in at least one subsection that extends along the direction of the longitudinal axis. In other words, the feed-throughs may have subsectional sections that resemble a hollow-cylindrical or polygonal channel, for example. The end piece, which roughly has a round or polygonal cross-section, is thus able to be installed in individual feed-through in positionally accurate manner only if inserted from the axial direction.

At least one of the end pieces may be connected to the internal conductor of a lead, using a connection element which is plastically deformed by a crimping process. The connection element, for example, may be an integral part of the end piece.

Furthermore, the coupler element may include a secondary latching element. This secondary latching element, which engages with at least one end piece, is used to axially secure the individual lead in form-fitting manner, in the sense of traction relief.

The cable may have a secondary latching element which may be used to axially secure a lead in that the secondary latching element is shifted in a direction that has a directional component orthogonal to the longitudinal axis. The shift direction may have a tangential orientation in relation to the longitudinal axis, i.e., orthogonal to the longitudinal axis, without intersecting it.

The body of the coupler element may be adapted to captively accommodate the secondary latching element.

The cable may have four leads, two leads being twisted together in each case. That is to say, the four leads are twisted together in the form of pairs.

Further features and aspects of example embodiments of the present invention are described in more detail below with reference to the appended Figures.

DETAILED DESCRIPTION

Figure 1:
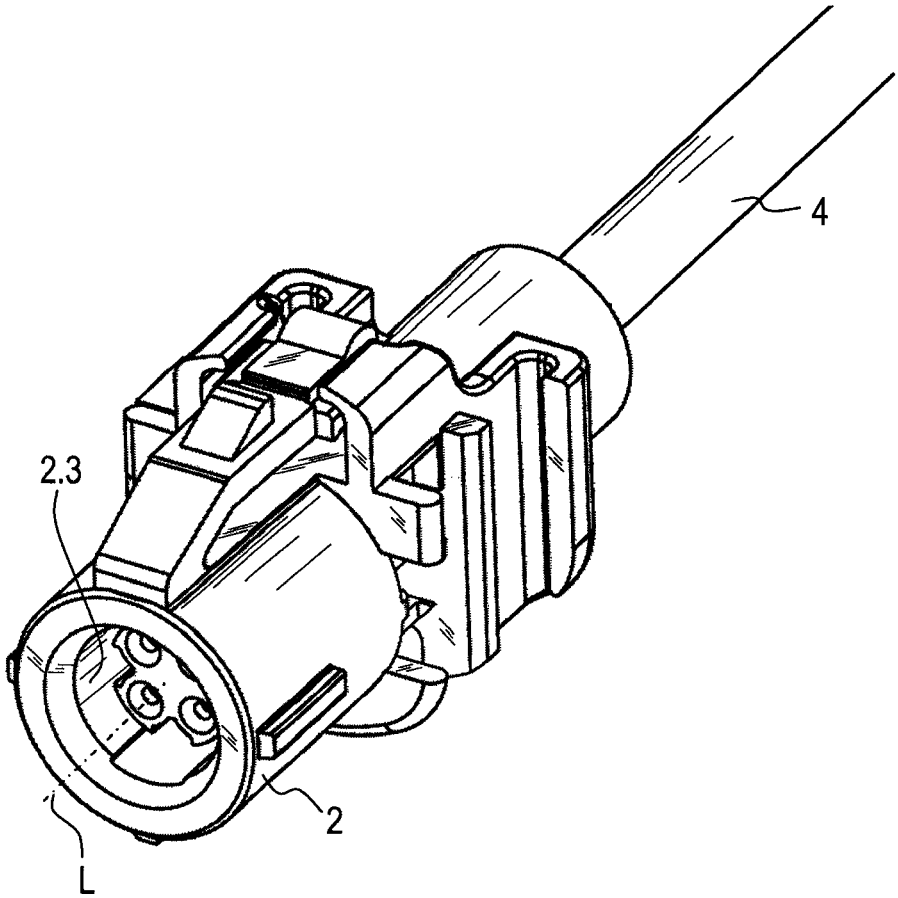
FIG. 1 is a perspective view of a cable according to an example embodiment of the present invention.

FIG. 1 illustrates a cable for the transmission of signals, to be installed in a vehicle, for example. Video images from a camera, for example, are able to be transmitted to an onboard computer with the aid of the signals, for which purpose Ethernet technology may be used, for instance. Via a coupler element, the end of the cable is able to be connected in separable manner to a corresponding mating element of another component, such as an element of an onboard electronics system, in the sense of a plug connection.

Figure 4:
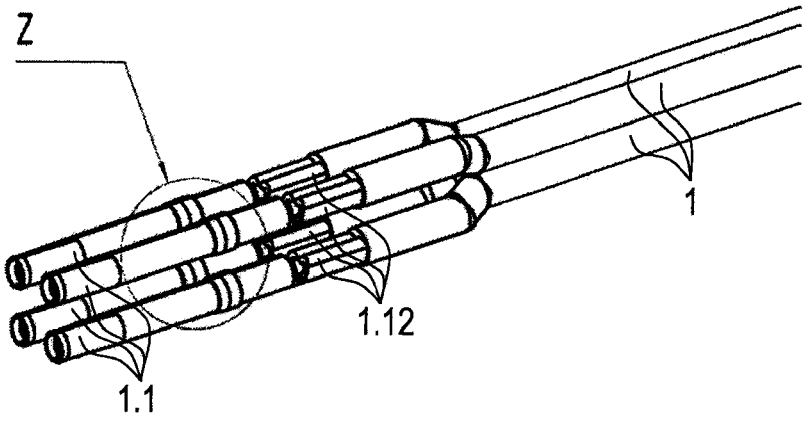
FIG. 4 is a perspective view of leads of the cable including end pieces.
Figure 5:
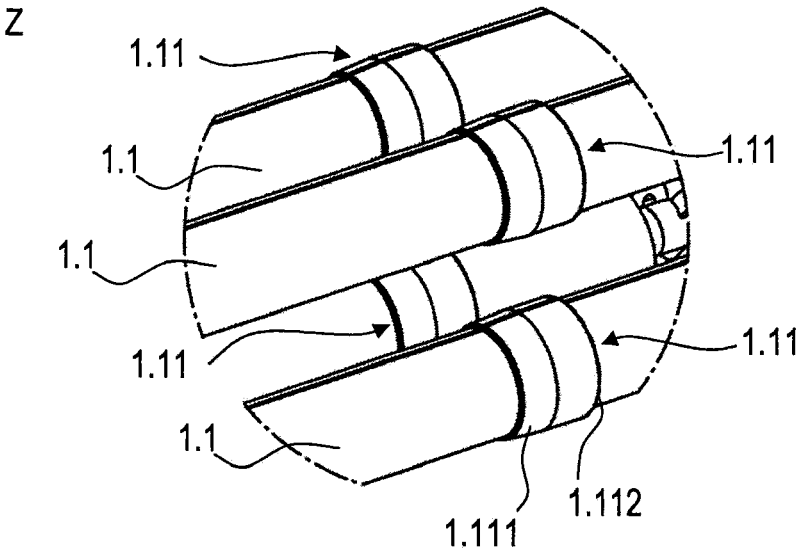
FIG. 5 is a perspective enlarged view of the end pieces.

In the exemplary embodiment illustrated, the cable has four leads 1 (see FIGS. 4 through 8), which are surrounded by an electrically insulating sheath 4 toward the outside. In addition, each of the four leads 1, as illustrated in FIG. 5, is provided with insulation around an internal conductor, which is removed only in the end region of each lead 1. In the end region, stripped of the insulation, the internal conductors are contacted by an end piece 1.1 in each case, using a crimping connection, for which purpose a connection element 1.12 of end piece 1.1 is plastically deformed around the internal conductor. In the region between connection element 1.12 and a substantially tubular region, end piece 1.1 has an indentation. Each end piece 1.1 furthermore has in its tubular region a first latching element 1.11, which is arranged as a circumferential collar in the exemplary embodiment illustrated. This circumferential collar acting as a first latching element 1.11 is provided with an insertion cone 1.111 and a sharp-edged impression 1.112, as can also be seen in FIG. 5.

Although leads 1 are illustrated as linear or elongated leads in the Figures for reasons of clarity, it should be appreciated that the cable may be arranged such that leads 1 are disposed as strands according to a twisted-pair principle. Two pairs of leads 1, disposed in the form of twisted pairs, may be provided, in particular. The cable may be arranged without a shield, which provides considerable cost and weight advantages in comparison with conventional cables for the transmission of signals in vehicles.

In addition, the cable includes a body 2, which is made of an electrically insulating material and is produced as an injection-molded plastic part, in particular. Body 2 has a longitudinal axis L, which represents an axis of symmetry in a first approximation. Four feed-throughs 2.1, which extend into a substantially cylindrical, inner part of body 2, are situated parallel to longitudinal axis L. The diameter of feed-throughs 2.1 is reduced at the end (at the left end in FIGS. 6 and 7), so that the inner diameter of feed-throughs 2.1 is smaller at this end than the outer diameter of end pieces 1.1. As a result, end pieces 1.1 or leads 1 are unable to be installed such that they project from body 2 at the particular end. In addition, feed-throughs 2.1 have second latching elements 2.11. These are integrally formed on body 2, as integral component of body 2. Latching elements 2.11 are elastically deflectable in the radial direction.

Figure 3:
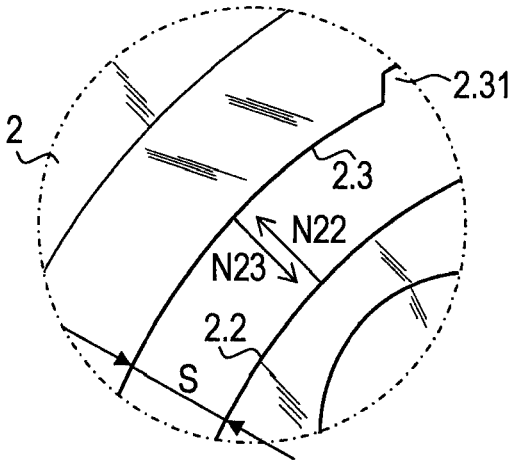
FIG. 3 is an enlarged front view of the cable.

In principle, a surface 2.2 of the part of body 2 lying on the inside may be assigned a normal vector N22 (see FIG. 3) which has a directional component parallel to the radial direction and is directed radially toward the outside, away from surface 2.2. Radially on the outside, body 2 has a substantially hollow-cylindrical region, which on the inside is delimited by an additional surface 2.3. This surface is aligned toward the inside, in the direction of longitudinal axis L, and thus has a normal vector N23, which has a directional component parallel to the radial direction and is oriented radially toward the inside, away from surface 2.3. In cross-section, surfaces 2.2, 2.3 consequently lie radially opposite each other, separated by an air gap S. End pieces 1.1 happen to lie in the same cross-section as well.

Figure 6:
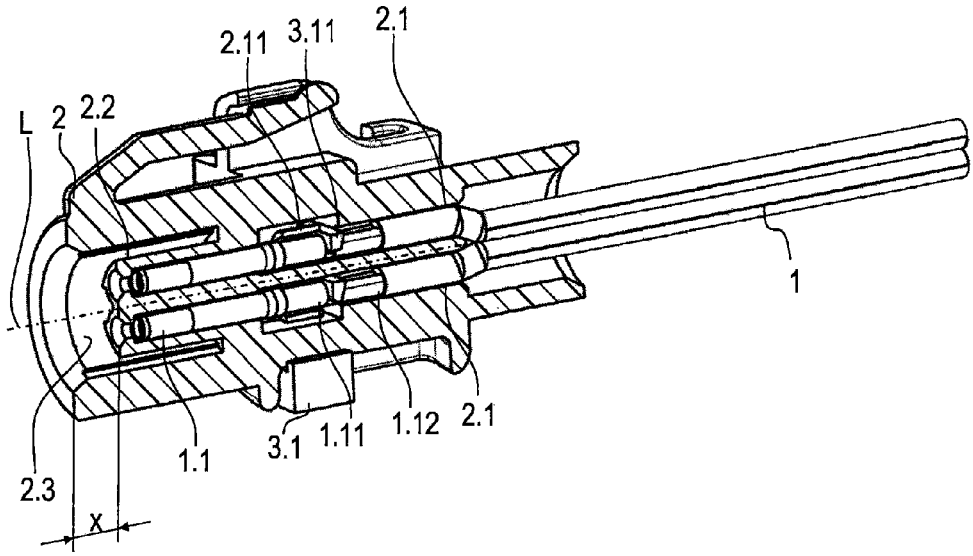
FIG. 6 is a perspective longitudinal cross-sectional view through a body of the cable.
Figure 7:
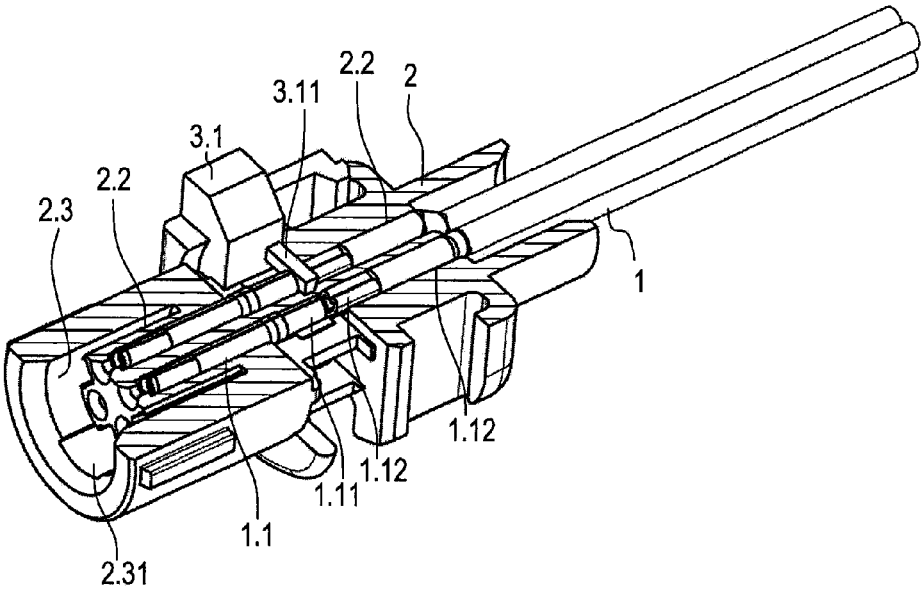
FIG. 7 is a perspective longitudinal cross-sectional view through the body of the cable.
Figure 8:
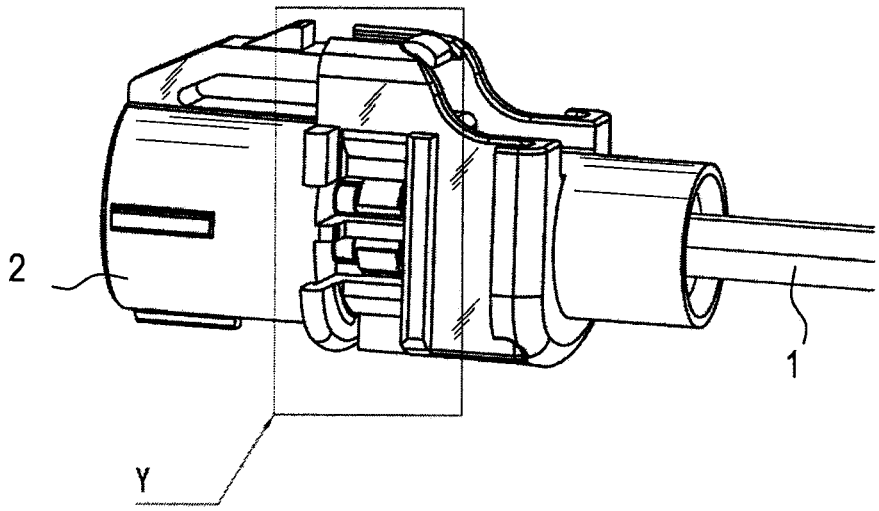
FIG. 8 is another perspective view of the cable.
Figure 9:
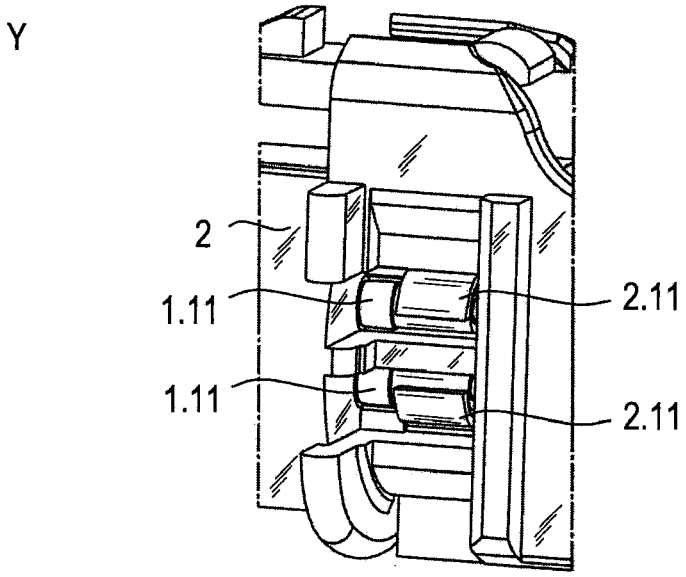
FIG. 9 is an enlarged perspective view of latching elements.

As illustrated in FIG. 6, the inner part of body 2 is axially set back, by a measure x, in relation to longitudinal axis L in comparison to the outer, substantially hollow-cylindrical region of body 2. In comparison with second surface 2.3, first surface 2.2 thus is axially set back with respect to longitudinal axis L.

Figure 2:
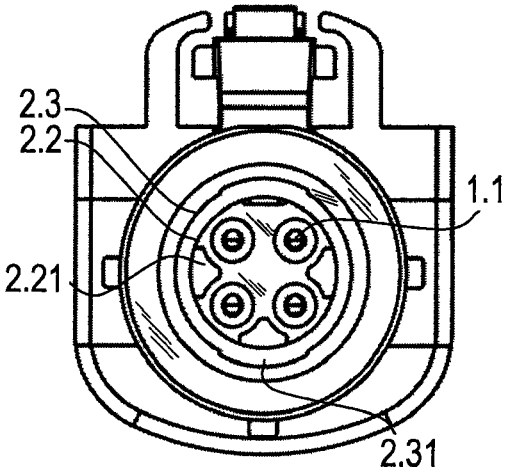
FIG. 2 is a front view of the cable.

For mechanical coding, i.e., for achieving a positionally correct assignment of the mating piece of the coupler element, body 2 is arranged such that points along a circumferential line on first surface 2.2 and on second surface 2.3 are at different distances from longitudinal axis L. Consequently, as illustrated in FIG. 2, for instance, body 2 is provided with indentations 2.21 on its substantially cylindrical, inner part, which indentations represent a deviation from an ideal cylinder. Correspondingly, the substantially hollow-cylindrical region of body 2 lying radially outside furthermore has indentations 2.31, which likewise extend parallel to longitudinal axis L.

Figure 10:
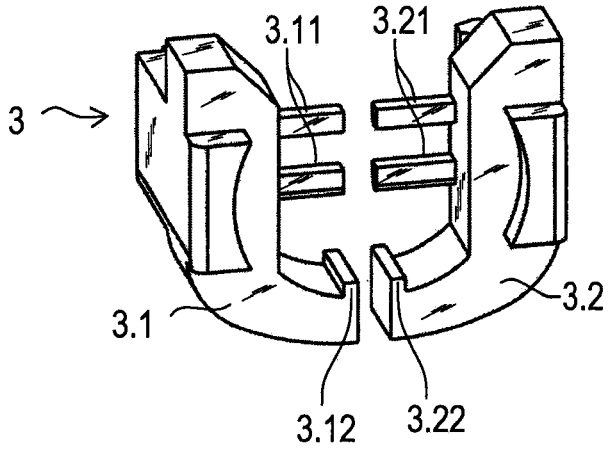
FIG. 10 is a perspective view of secondary latching elements of the cable.

To optimize the connection, especially to improve the tension relief, the coupler element additionally includes a so-called secondary latching element, which has a first latching part 3.1 and a second latching part 3.2 according to FIG. 10. Integrally formed latching parts 3.1, 3.2 produced by an injection-molding method have projections 3.11, 3.21. When pre-assembling the cable, end pieces 1.1 are first crimped onto the inner conductors of leads 1, stripped of insulation, so that a system according to FIG. 4 is ultimately obtained. Then, end pieces 1.1 are axially inserted into feed-throughs 2.1 from behind, i.e., from the left in FIGS. 6 and 7, until first latching elements 1.11 lock together with second latching elements 2.11. During this process, insertion cones 1.111 of latching elements 1.11 on end pieces 1.1 initially push latching elements 2.11 of body 2 radially outwardly. When end pieces 1.1 are shifted farther in the axial direction, latching elements 2.11 of body 2 lock into place, radially inwardly, once latching elements 1.11, arranged as a collar, have slipped past them. In this position, latching elements 2.11 of body 2 then secure leads 1 in the axial direction by sharp-edged impression 1.112 of latching elements 1.11 on end pieces 1.1. Because of the reduced diameter of feed-throughs 2.1 at the end of body 2, leads 1 are axially secured in the particular opposite direction. Furthermore, latching elements 2.11 of body 2 are also radially prestressed in the ultimately installed position and thus retain end pieces 1.1 in feed-throughs 2.1 without play.

Because monolithic body 2 made from plastic is electrically non-conductive, feed-throughs 2.1 are mutually electrically insulating with regard to end pieces 1.1, so that a short-circuit or leak current between end pieces 1.1 inside body 2 is impossible.

Feed-throughs 2.1 are arranged such that they completely surround end pieces 1.1 across their circumference, at least in a subsection extending along the direction of longitudinal axis L. As a result, an insertion of end pieces 1.1 is possible only from the axial direction and not from a radial or tangential direction. Because of this configuration, an exceedingly high measure of precision is able to be achieved with regard to a positionally accurate placement of end pieces 1.1. A transmission at high data rates using an unshielded cable in a vehicle is able to be ensured only if this type of positional accuracy is provided.

Figure 11:
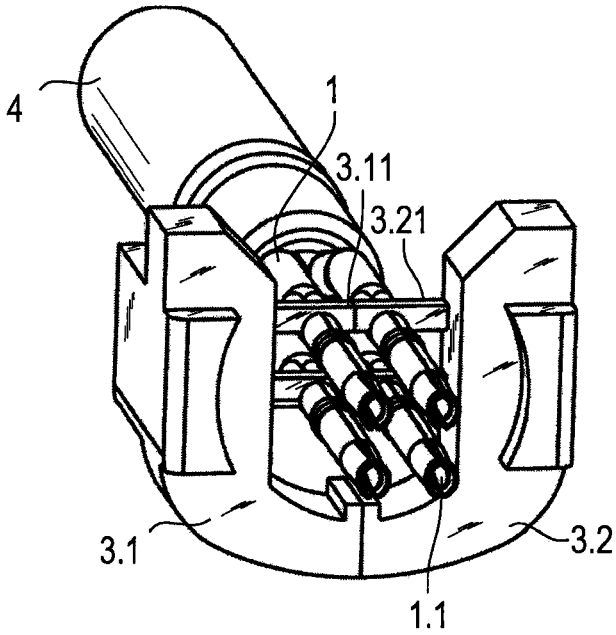
FIG. 11 is a perspective view of secondary latching elements of the cable having leads.

Once end pieces 1.1 have locked into place inside body 2, locking parts 3.1, 3.2 of the secondary locking element are inserted into corresponding channels of body 2 in tangential direction (in relation to longitudinal axis L), so that projections 3.11, 3.12 are inserted into the indentations of end pieces 1.1. FIG. 11 shows the cable without body 2, so that the method of action of the secondary latching element is discernible, in which projections 3.11, 3.12 engage with end piece 1.1 and secure leads 1 in form-fitting manner in the axial direction, or provide tension relief.

In their final position, locking elements 3.1, 3.2 are captively fixed in place on body 2, using snap tabs 3.12, 3.22, and accommodated in corresponding recesses of body 2.

The coupler element of the cable, or body 2, is arranged such that the two surfaces 2.2, 2.3 are used as guide for a mating piece when the mating piece is plugged into the coupler element. In the process, surface 2.3 having the radially inwardly oriented normal vector N23, initially provides guidance, due to offset x (FIG. 7), and a plug-in connection true to position is achievable with the aid of longitudinal fins of the mating piece, which engage in recesses 2.31. Only after path x has been covered when establishing a plug-in connection, does surface 2.2 begin to act as second guide surface. Here, too, a secured position in the sense of mechanical coding is achieved by an interplay of recesses 2.21 and a mating piece, which is correspondingly equipped with longitudinal fins.

Example embodiments of the present invention include systems in which, for example, latching elements 1.11 are arranged as notches, which are inwardly offset with respect to the outer diameter of end pieces 1.1. In a similar manner, latching elements 2.11 of body 2 may be arranged as detents, for example, which engage with the notches.

What is claimed is:

1. A cable for transmitting signals, comprising:

a plurality of leads;

an electrically conductive end piece fixedly provided on an internal conductor of each lead, at least one end piece including a first latch;

a coupler having a body formed of one piece from an insulating material and having a longitudinal axis;

wherein the body includes parallel feed-throughs, electrically isolated from each other, that accommodate the end pieces, at least one feed-through including a second latch arranged as an integral component of the body;

wherein the end piece is inserted into the feed-through such that the first latch cooperates with the second latch to lock the end piece and the body; and wherein the body includes a first surface and a second surface arranged as a guide for a mating piece of the coupler, the first surface having a radially outwardly directed normal vector and the second surface having a radially inwardly directed normal vector; and wherein a lead is axially secured in form-locking manner by a secondary latching element that engages at the end piece by a shift of the secondary latching element in a tangential and orthogonal direction to the longitudinal axis without intersecting it.

2. The cable according to claim 1, wherein the cable is arranged without a shield.

3. The cable according to claim 1, wherein points along a circumferential line on the first surface and/or on the second surface have different distances from the longitudinal axis, for mechanical coding.

4. The cable according to claim 1, wherein the first surface is axially set back in relation to the longitudinal axis, in comparison with the second surface.

5. The cable according to claim 1, wherein in cross-section, the first surfaces and the second surface are located radially opposite each other and are separated by an air gap.

6. The cable according to claim 1, wherein the feed-throughs completely surround the end pieces along a circumferential line on the end piece, at least in a subsection extending along a direction of the longitudinal axis.

7. The cable according to claim 1, wherein at least one of the end pieces is connected to an internal conductor of a lead, via a plastically, crimpedly deformed connection element.

8. The cable according to claim 1, further comprising a secondary latch captively accommodated by the body.

9. The cable according to claim 1, wherein the cable includes a first pair of leads twisted together, and a second pair of leads twisted together.

* * * * *